US008881439B2

(12) United States Patent
Reynolds et al.

(10) Patent No.: US 8,881,439 B2
(45) Date of Patent: Nov. 11, 2014

(54) GREETING CARD WITH SPINNER ACTIVATED MULTIMEDIA CONTENT

(71) Applicant: Hallmark Cards, Incorporated, Kansas City, MO (US)

(72) Inventors: David Lynn Reynolds, Blue Springs, MO (US); Kaitlyn Jerome, Kansas City, MO (US); Michael Robert Adair, Overland Park, KS (US); Orlanda Dominic Lacy, Kansas City, MO (US); Douglas M. Bowen, Fitchburg, MA (US)

(73) Assignee: Hallmark Cards, Incorporated, Kansas City, MO (US)

( * ) Notice: Subject to any disclaimer, the term of this patent is extended or adjusted under 35 U.S.C. 154(b) by 57 days.

(21) Appl. No.: 13/838,543

(22) Filed: Mar. 15, 2013

(65) Prior Publication Data

US 2014/0259817 A1 Sep. 18, 2014

(51) Int. Cl.
*G09F 1/00* (2006.01)
*B42D 15/04* (2006.01)

(52) U.S. Cl.
CPC ..... *B42D 15/045* (2013.01); *G09F 1/00* (2013.01)
USPC ..... 40/124.04

(58) Field of Classification Search
CPC ..... G06F 1/00; G06F 1/04; G06F 1/06; G06F 1/10
USPC ..... 40/124.03
See application file for complete search history.

(56) References Cited

U.S. PATENT DOCUMENTS

| | | | | |
|---|---|---|---|---|
| 6,357,152 | B1 * | 3/2002 | Brooks et al. | 40/419 |
| 6,591,523 | B2 * | 7/2003 | Pines | 40/124.03 |
| 8,164,585 | B2 * | 4/2012 | Oh | 345/204 |
| 8,490,306 | B2 * | 7/2013 | Guo et al. | 40/124.08 |
| 8,584,385 | B2 * | 11/2013 | Mayer et al. | 40/124.03 |
| 8,661,719 | B2 * | 3/2014 | Hughes et al. | 40/124.04 |
| 2008/0032587 | A1 * | 2/2008 | Krivanek et al. | 446/149 |

OTHER PUBLICATIONS http://debbiedesigns.typepad.com/muse_and_amuse/2009/10/button-santa-spinner.html.
http://prairiepaperandink.typepad.com/amyr/2008/05/make-a-big-spla.html.
http://archive.constantcontact.com/fs046/1101861700797/archive/1102262363911.html.

* cited by examiner

*Primary Examiner* — Charles A. Fox
*Assistant Examiner* — Shin Kim
(74) *Attorney, Agent, or Firm* — Shook, Hardy & Bacon L.L.P.

(57) ABSTRACT

A greeting card has a card body comprising at least a front panel and electrical components. The front panel contains an opening that acts as a track. A spinner including two wheels spaced apart and coupled together with an axle rotatably engages the track are positioned on opposite sides of the front panel. The spinner moves along the track by virtue of gravity when the greeting card is being tilted. The electrical components may include a power source, a sound module having an audio file stored therein, a speaker, and a switch located adjacent to the track. The spinner activates the switch when the spinner moves adjacent to the location of the switch which in turn initiates playback of the audio file through the speaker.

20 Claims, 4 Drawing Sheets

GREETING CARD WITH SPINNER ACTIVATED MULTIMEDIA CONTENT

CROSS-REFERENCE TO RELATED APPLICATIONS

Not applicable.

STATEMENT REGARDING FEDERALLY SPONSORED RESEARCH OR DEVELOPMENT

Not applicable.

BRIEF SUMMARY OF THE INVENTION

The present invention relates to a greeting card with spinner activated multimedia content. More specifically, this invention relates to a greeting card having a spinner mounted on a track whereby multimedia content plays when the spinner activates one or more switches located on the track.

In an effort to provide consumers with a more personalized and interactive experience, the present invention permits users to control the movement of the spinner by tilting the greeting card at desired angles. When the greeting card is tilted, gravity moves the spinner along an opening in the front panel of the greeting card that acts as a track. Multimedia content is activated when the spinner moves over or near one or more switches located adjacent to the track. Multimedia content may be activated according to the location of the spinner or the time duration of the spinner's movement.

In one embodiment, a card body has front and rear panels that are parallel to each other and are separated by an interior cavity. The front panel has an opening therein that acts as a track. A spinner has two wheels spaced apart by and attached to an axle that rides along a periphery of the track. When the greeting card is tilted, gravity moves the spinner along the track. The card body contains electrical components located in the interior cavity, including at least a power source and a switch located adjacent to the track. The spinner activates the switch by moving to a location adjacent to the switch. The switch then in turn activates the electrical components.

In another embodiment, a card body has multiple parallel panels, some of which contain die-cut openings that act as tracks. Each track contains one or more spinners comprised of two wheels attached to an axle. The spinners move along the tracks by virtue of gravity when the greeting card is tilted. Electrical components are coupled with the card body and include multiple switches located along the tracks. Spinners activate the switches while moving along the tracks. Activated switches initiate the electrical components.

In yet another embodiment, a card body has at least one panel having a die-cut opening that acts as a track. A spinner having two wheels coupled with an axle rotatably engages the track. The wheels have diameters of dimensions that exceed a dimension of the width of the track such that the wheels do not pass through the opening that forms the track. Electrical components are coupled with the card body and include a power source, a switch positioned at a location along the track, a sound module having an audio file stored therein, and a speaker. The spinner activates the switch by moving adjacent to the location of the switch and the switch in turn initiates the playback of the audio file through the speaker.

Further objects, features and advantages of the present invention over the prior art will become apparent from the detailed description of the drawings which follows, when considered with the attached figures.

BRIEF DESCRIPTION OF THE SEVERAL VIEWS OF THE DRAWING

The features of the invention noted above are explained in more detail with reference to the embodiments illustrated in the attached drawing figures, in which like reference numerals denote like elements, in which FIGS. 1-6 illustrate several possible embodiments of the present invention, and in which:

FIG. 1 is an unfolded view of an exemplary greeting card constructed in accordance with an embodiment of the present invention;

FIG. 4 depicts a front elevation view of an exemplary second embodiment of a greeting card with a looped track and multiple spinners;

FIG. 5 depicts a front elevation view of an exemplary third embodiment of a greeting card with multiple branched tracks; and FIG. 6 depicts a front elevation view of an exemplary fourth embodiment of a greeting card with a free-moving arm pivoting adjacent one end of a track.

DETAILED DESCRIPTION OF THE INVENTION

Figure 1:
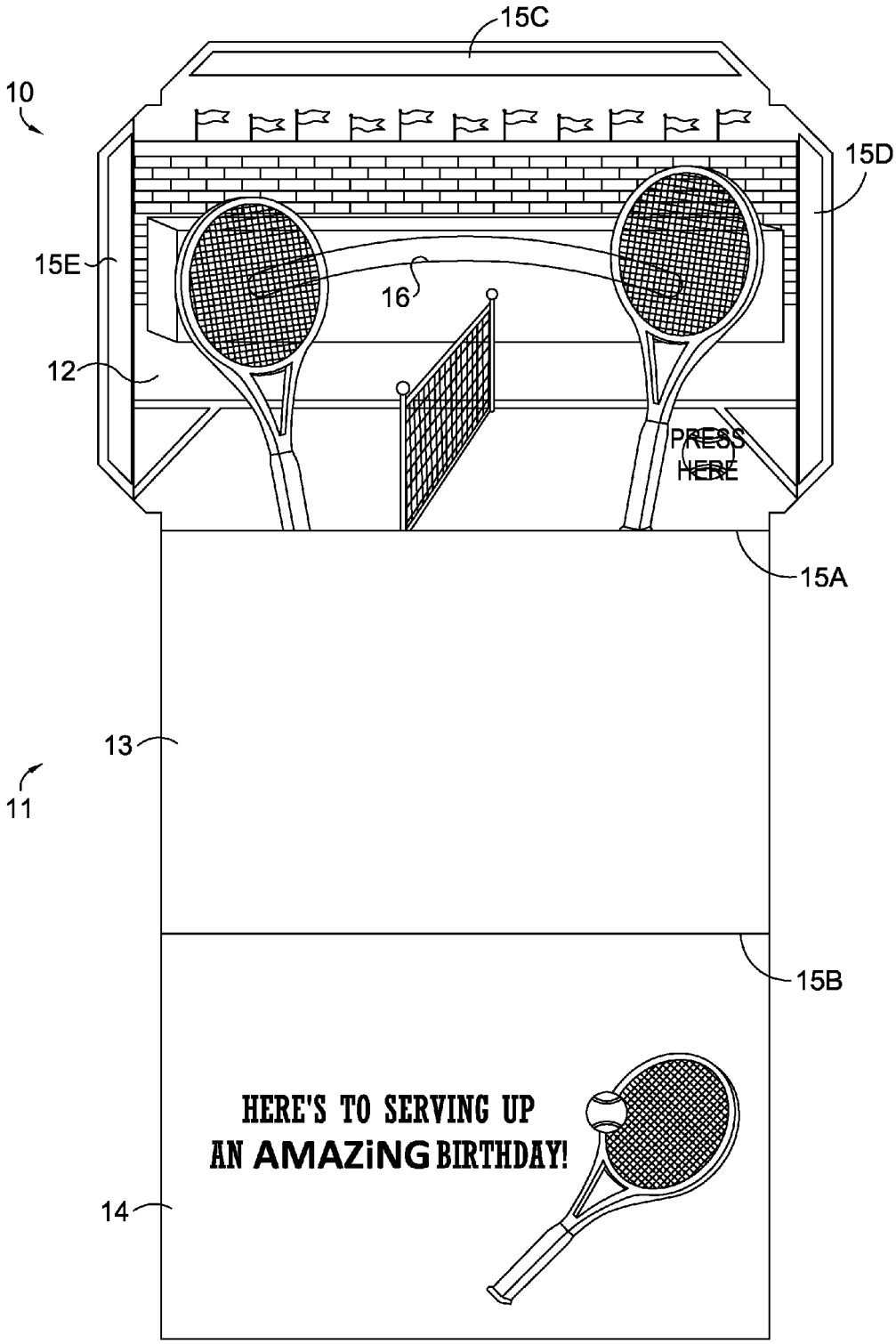

Referring now to the drawings in more detail and initially to FIG. 1, numeral 10 generally designates an unfolded greeting card constructed in accordance with an embodiment of the present invention. The greeting card 10 includes a card body 11. In the illustrated embodiment, the card body 11 includes a front panel 12, a back panel 13, and an interior panel 14. As readily understood by one of ordinary skill in the art, the card body 11 may consist of a single piece of card stock that has been folded along fold lines 15A and 15B to provide panels 12, 13 and 14, as depicted in the illustrated embodiment. It would also be readily understood that the panels 12, 13, 14 may be individual panels that are joined to one another by any number of methods known in the art and that the card body 11 may have any number of panels.

Figure 2A:
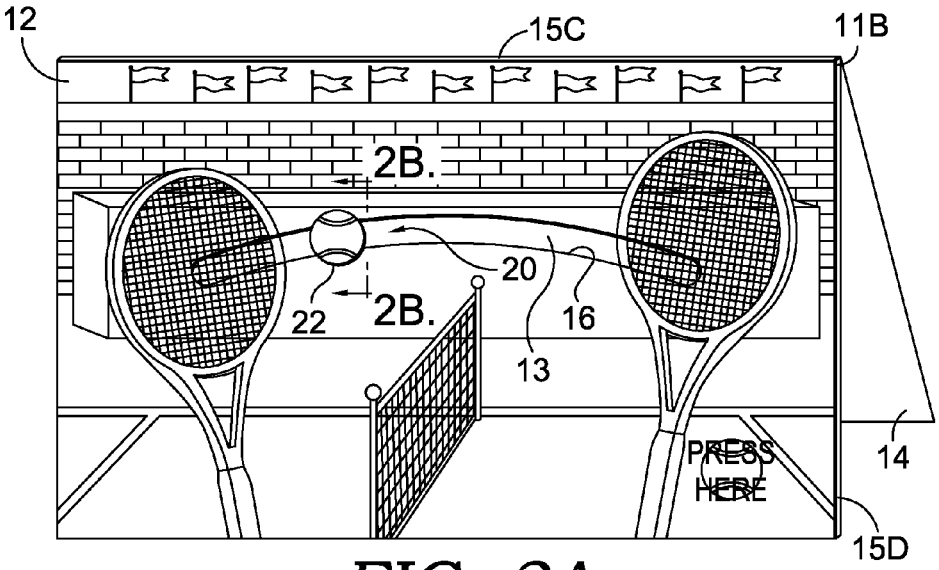
FIG. 2A is a folded front perspective view of the greeting card of FIG. 1.

Card body 11 also includes side panels in the shape of flaps 15C-E along three sides of the front panel 12. In the illustrated embodiment, the back panel 13 is folded back and under front panel 12 such that it overlies the back panel 13. Side panels 15C-E are folded back and under the front panel 12 and attached to the back panel 13 to define an interior cavity 11B (see FIG. 2A) between the front panel 12 and the back panel 13. FIG. 2A depicts a folded perspective view of the greeting card in FIG. 1. Portions of the side panels 15C and 15D can be seen bridging the interior cavity 11B between the front panel 12 and the back panel 13 to form a box-like shape. This can be created by each side of the front panel 12 having dual parallel fold lines, as understood by one of ordinary skill in the art. The interior panel 14 is also folded back toward the back panel 13 as shown.

Continuing with FIG. 2A, a spinner 20 is shown. The spinner 20 is mounted in a track 16. The track 16 can be an opening or channel die-cut into the front panel 12 such that a portion of the back panel 13 is visible through the track 16.

Figure 2B:
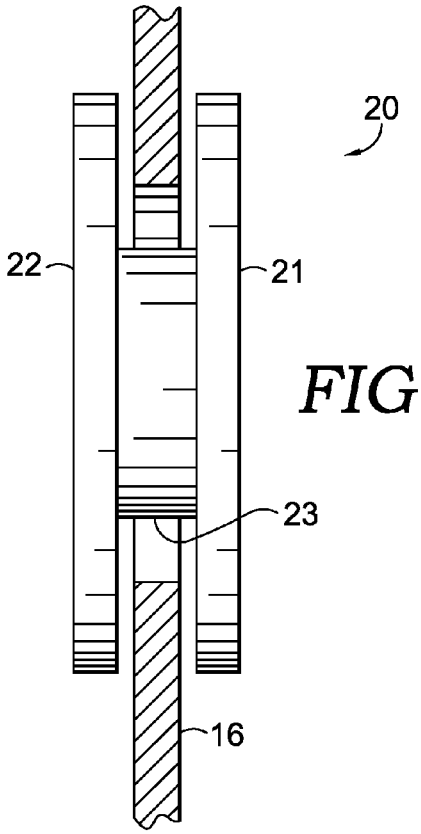
FIG. 2B is a fragmentary, side elevation view of the spinner of the greeting card of FIG. 1 taken along the line 2B-2B in FIG. 2A.

Turning briefly to FIG. 2B, a side view of the spinner 20 is depicted. The spinner 20 includes first or outer wheel 22, a second or inner wheel 21, and an axle 23. The first wheel 22 is located on a front side of the front panel 12 and the second wheel 21 is located on a back side of the front panel 12, and in turn occupies the interior cavity 11B between the front panel 12 and the rear panel 13. The wheels 21 and 22 may be constructed from metal or heavy board stock and are coupled adjacent opposite ends of the axle 23. The axle 23 may be metal or foam and grips or engages a peripheral edge of track 16. The axle 23 is purposefully smaller in diameter than a width of track 16 such that axle 23 is free to move or spin along the track 16. The wheels 21 and 22 have diameters greater than the width of track 16 such that the wheels 21 and 22 cannot pass through the opening of the track 16. The wheels 21 and 22 may be adhered to the axle 23 such that they may spin as one entity with the axle 23 or they may spin independently of the axle 23 or of each other.

Turning back to FIG. 2A, when the user tilts the front panel 12, gravity causes the spinner 20 to spin or rotate and move in the direction of the tilt along the track 16. Naturally, the steeper the tilt, the faster the spinner 20 moves along the track 16.

Figure 3A:
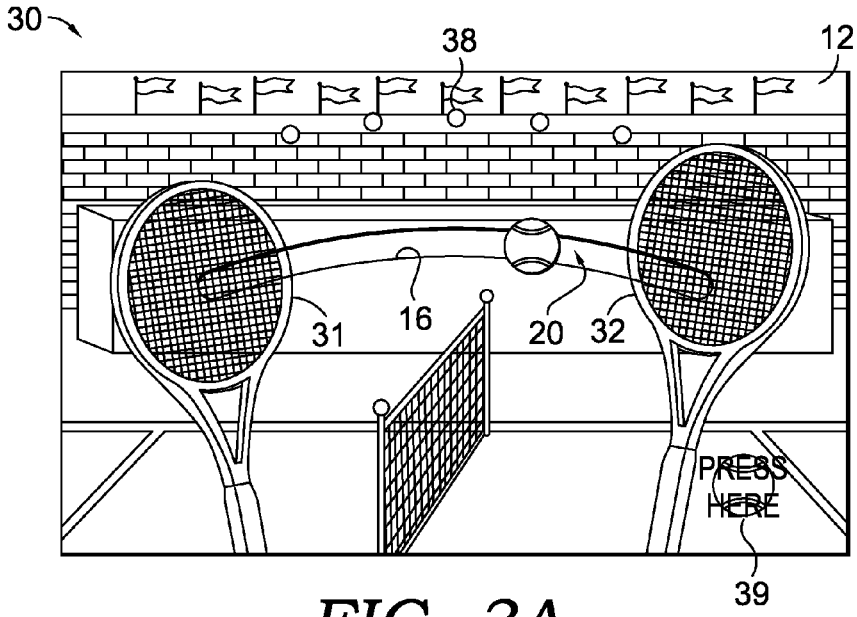
FIG. 3A is a front elevation view of the greeting card of FIG. 1.

Turning now to FIG. 3A, numeral 30 refers to the front view of the greeting card of FIG. 1. Images of racquets 31 and 32 are printed on the front panel 12. The spinner 20 is mounted in the track 16 and moves in the direction of tilt along track 16. For instance, the user can tilt the front panel 12 to the right in order to move the spinner 20 towards racquet 32. In the illustrated embodiment, the movement of spinner 20 between the racquets 31 and 32 simulates a game of tennis. In other embodiments, a moving spinner can simulate hitting a baseball with a bat or shooting a basketball into a basket. There are lights 38 above the track 16 as well as a button 39 at the bottom right of the front panel 12. The button 39 may be on the front panel 12 or may be behind the front panel 12 in the interior cavity 11B. If behind the front panel 12, a "press here" indicator may be placed on the front side of the front panel 12 to inform users where to press on the front panel 12 to activate the button 39 there behind. The lights 38 may flash in order to simulate camera flashes in the stands. The lights 38 may also flash when the spinner 20 reaches a particular location along the track 16. For instance, the lights 38 may flash when the spinner 20 reaches the racquet 32 at the end of the track 16. The button 39 may be present to manage the power source of the electrical components connected to the lights 38. If the lights 38 operate on batteries, then the user has the option of depressing the button 39 to turn the power source on or off in order to conserve electrical resources. A timer may be used to shut the power off after a predetermined period of inactivity. The button 39 may then be used to reactivate the electrical components.

Figure 3B:
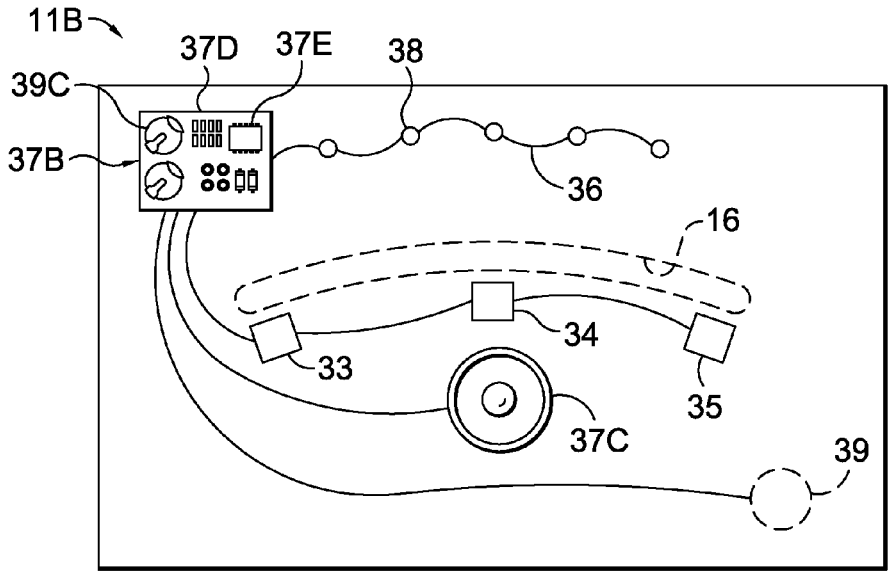
FIG. 3B is an interior view of the greeting card of FIG. 1 with the front cover panel thereof removed to reveal electrical components therein.

Turning now to FIG. 3B, an interior view of the greeting card of FIG. 1 is illustrated by removing the front cover panel to reveal the electrical components. Some of the electrical components, for ease of manufacture and assembly, may be provided on a carrier 37B. The carrier 37B may be adhered to the front panel 12 or the back panel 13 inside the interior cavity 11B (see FIG. 2A). Alternatively, some of the electrical components may be individually positioned on the front panel 12 or the back panel 13 without a carrier like 37B.

The electrical components may include a speaker 37C, the button 39 for controlling a power supply 39C, the lights 38, and first, second and third switches 33, 34, and 35. Any number and type of switches (e.g., contact, non-contact, magnetic, etc.) may be used. The power supply 39C may be provided by a battery. The electrical components are connected via wires 36 to create an electric circuit. In addition, a circuit board 37D and an integrated circuit 37E may be coupled with the carrier 37B.

Switches 33, 34, and 35 may activate different types of multimedia responses. As the spinner 20 moves along the track 16, it may come in contact with the switches 33, 34, and 35, not necessarily in that order. Each contact may activate a different multimedia response. For instance, contacting switch 33 may activate the speaker 37C to play a prerecorded audio such as "good volley." Contacting switch 35 may activate the speaker 37C to play a prerecorded audio such as "excellent shot." Contacting switch 34 may activate the lights 38 to flash for a predetermined duration of time. The user controls the movement of the spinner 20 by tilting the front panel 12. Therefore the multimedia content is a response to the user's hand movements, which fosters an interactive relationship between the user and the greeting card 10. In addition, multimedia content may be tied to a time element. For instance, making the spinner 20 contact switch 35 may activate a time counter whereby if the spinner does not reach switch 33 thereafter within 5 seconds, the speaker plays a prerecorded audio such as "missed." Furthermore, the quicker the user can move the spinner from switch 33 to switch 35 and back, the faster the lights 38 may flash.

Figure 4:
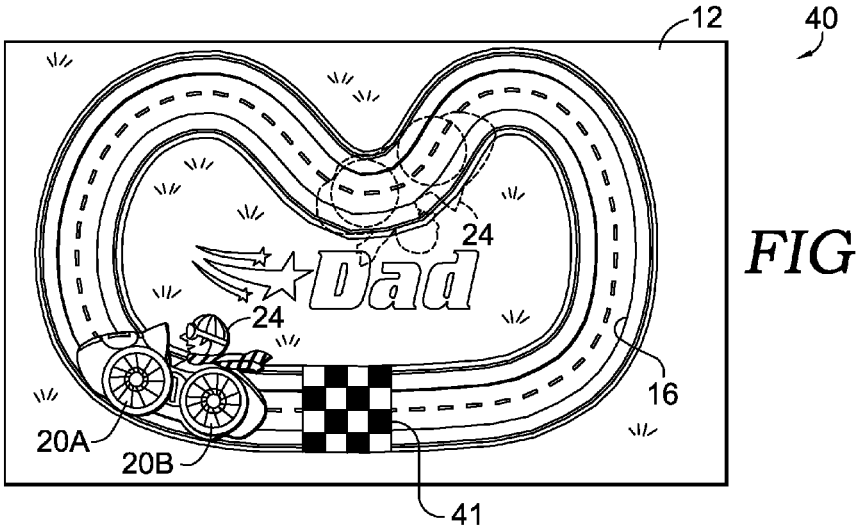
Figure 5:
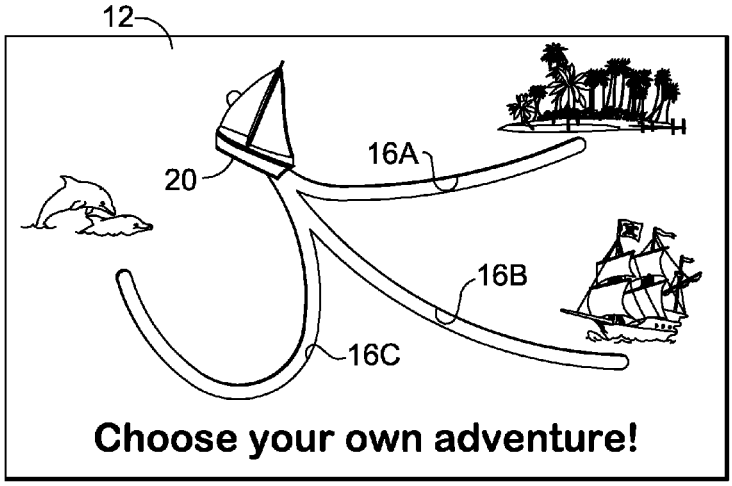
Figure 6:
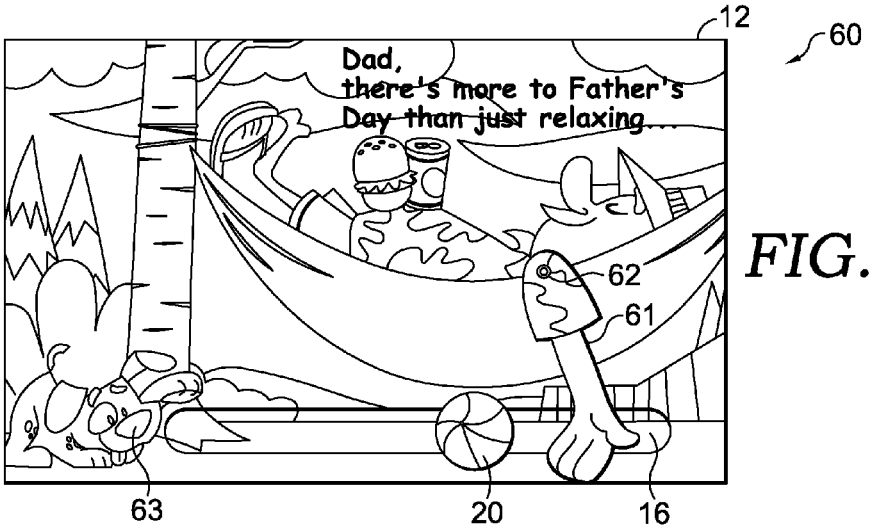

FIGS. 4-6 illustrate different exemplary greeting cards. FIG. 4 depicts the front panel 12 of a greeting card 40 with spinners 20A and 20B. Spinners 20A and 20B move along a looped track 16 when the greeting card 40 is tilted. Spinners 20A and 20B move independent of each other, but are coupled with a carriage 24. In this embodiment, the carriage 24 is in the shape of a racing car body with a driver's head extending therefrom. In one embodiment, when spinner 20A moves over location 41, a recording may be played such as "start your engine." When the spinner moves around the entire length of track 16 and returns to location 41, a different recording may be played such as "way to go." Different recordings may be played depending on the amount of time it takes spinner 20A to traverse the entire track 16. In other embodiments, there may also be multiple tracks on greeting card 40. For instance, two parallel straight tracks, each with a separate spinner mounted thereon. The spinners may resemble cars in order to simulate drag racing.

FIG. 5 depicts the front panel 12 of a greeting card 50 containing a single track 16 with multiple branches. The user can decide which of the branches 16A, 16B, and 16C to take and then tilt the front panel 12 accordingly. The spinner 20 has a front wheel in the shape of (or has a cutout affixed thereto in the shape of) a sail boat.

FIG. 6 depicts the front panel 12 of a greeting card 60 with a free-swinging arm 61 attached to a pivot 62 on one end. When the user tilts the greeting card 60 towards the image of a dog 63, the arm 61 swings in the direction of the tilt as if pushing the spinner 20 towards the dog 63. There may be other variations wherein different swinging portions interact with the spinner 20 as the user tilts the greeting card at various angles. In addition, there can be a switch attached to the hand portion of arm 61 whereby upon contact with the spinner 20, multimedia content activates, such as playback of a recording of "fetch boy." Similarly, when the spinner 20 reaches the end of the track 16 adjacent the dog 63, a switch may be activated to trigger multimedia content, such as playback of a recording of a dog barking followed by "good boy."

From the foregoing it will be seen that this invention is one well adapted to attain all ends and objects hereinabove set forth together with the other advantages which are obvious and which are inherent to the method and apparatus. It will be understood that certain features and subcombinations are of utility and may be employed without reference to other features and subcombinations. For example, while the present invention has been described as occurring in a greeting card, the invention may be used in other items, such as a book, a picture frame, a gift bag, etc. This is contemplated by and is within the scope of the invention.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

The invention claimed is:

1. A greeting card comprising:

a card body having a front panel and a rear panel, wherein the front and rear panels are generally parallel to each other and are separated by an interior cavity, and wherein the front panel includes a first opening therein through which the rear panel can be seen and that acts as a first track;

a first spinner comprising a first wheel and a second wheel that are spaced apart by and coupled together with a first axle, wherein the first axle is received in the opening and movably engages the first track; and electrical components coupled with the card body, wherein the electrical components include a power source and at least one switch, and wherein the switch is activated by the first spinner at one or more locations along the first track, thereby activating the electrical components.

2. The greeting card of claim 1, wherein the card body is a single, unitary card blank having the front panel and the rear panel separated by one or more fold lines.

3. The greeting card of claim 2, wherein the card body further comprises one or more side panels, wherein when the card body is folded, the front and rear panels are parallel to each other and spaced apart from each other by the one or more side panels.

4. The greeting card of claim 2, wherein the card body further comprises an interior panel separated from the rear panel by one or more fold lines.

5. The greeting card of claim 1, further comprising a second opening in the front panel through which the rear panel can be seen and that acts as a second track.

6. The greeting card of claim 5, further comprising a second spinner having a first wheel and a second wheel that are spaced apart by and coupled together with a second axle, wherein the second axle is received in the second opening and movably engages the second track.

7. The greeting card of claim 1, wherein the first and second wheels rotatably engage the first axle.

8. The greeting card of claim 1, wherein the first wheel or the second wheel resembles a shape such as a ball or a tire of an automobile.

9. The greeting card of claim 1, wherein the spinner moves along the first track by a pull of gravity when the greeting card is tilted.

10. The greeting card of claim 1, wherein the first track can be one of several configurations such as straight, curved, branched, or looped.

11. A greeting card comprising:

a card body having a plurality of panels that are generally parallel to each other;

a subset of the plurality of panels each having one or more die-cut openings therein acting as tracks;

one or more spinners, each having a first wheel and a second wheel coupled together and spaced apart by an axle that is movably received in the one or more openings and rotatably engages the one or more die-cut tracks; and electrical components coupled with the card body, wherein the electrical components include a power source and one or more switches, wherein the one or more spinners activate the one or more switches at one or more locations along the tracks of the one or more openings, thereby activating the electrical components.

12. The greeting card of claim 11, wherein some of the one or more spinners are coupled to each other thereby movably received in a same opening and rotatably engage a same die-cut track.

13. The greeting card of claim 11, wherein the one or more spinners move along the tracks of the one or more openings by virtue of gravity when the greeting card is tilted.

14. The greeting card of claim 11, wherein the tracks of the one or more openings can be one of several configurations such as straight, curved, branched, or looped.

15. A greeting card comprising:

a card body having at least one panel with a front side and an opposed rear side, the panel having a die-cut opening therethrough which functions as a track; wherein the opening is elongated in nature and has a width of a first dimension;

a spinner comprising a first wheel and a second wheel that are spaced apart by and coupled with an axle, wherein the axle is received in the opening and rotatably engages the track, wherein the first wheel is on the front side of the panel and the second wheel is on the rear side of the panel, and wherein the wheels have a diameter of a second or third dimension that is greater than the first dimension of the opening, whereby the wheels do not pass through the opening; and electrical components coupled with the card body and including a power source, a first switch positioned adjacent to the opening at a first location, a sound module having an audio file stored therein, and a speaker, wherein the spinner activates the first switch when the spinner is adjacent to the first location, and wherein activation of the first switch initiates playback of the audio file through the speaker.

16. The greeting card of claim 15, wherein the spinner moves along the track of the opening by virtue of gravity when the greeting card is tilted.

17. The greeting card of claim 15, wherein the electrical components further include one or more lights electrically coupled with one of the first and a second switch positioned adjacent to the opening at one of the first and a second location, whereby the spinner activates one of the first and the second switch when the spinner is adjacent to one of the first and a second location, whereby activation of the one of the first and a second switch activates the one or more lights.

18. The greeting card of claim 15, wherein the track of the opening is one of several configurations such as straight, curved, branched, and looped.

19. The greeting card of claim 15, wherein the first and second wheels rotatably engage the axle.

20. The greeting card of claim 15, wherein the first wheel or the second wheel resembles one of several shapes such as a ball or a wheel of an automobile.

* * * * *